US006571716B2

(12) United States Patent
Albrich

(10) Patent No.: US 6,571,716 B2
(45) Date of Patent: Jun. 3, 2003

(54) INSTALLATION FOR CARRYING PERSONS FROM A HIGHER STATION TOWARDS A LOWER STATION

(75) Inventor: Reinhard Albrich, Dornbirn (AT)

(73) Assignee: Innova Patent GmbH, Wolfurt (AU)

( * ) Notice: Subject to any disclaimer, the term of this patent is extended or adjusted under 35 U.S.C. 154(b) by 0 days.

(21) Appl. No.: 10/078,128

(22) Filed: Feb. 19, 2002

(65) Prior Publication Data

US 2002/0124763 A1 Sep. 12, 2002

(30) Foreign Application Priority Data

Mar. 7, 2001 (AT) ..... 357/2001

(51) Int. Cl.[7] ..... E01B 25/22
(52) U.S. Cl. ..... 104/123
(58) Field of Search ..... 104/27, 28, 87, 104/89, 91, 94, 95, 112, 123, 125, 126, 173.1, 173.2, 178; 238/151, 174, 173, 179, 183, 243, 244, 251, 252

(56) References Cited

U.S. PATENT DOCUMENTS

| | | | | |
|---|---|---|---|---|
| 2,088,430 A | * | 7/1937 | Nelles | 104/123 |
| 3,858,520 A | * | 1/1975 | Patin | 104/112 |

FOREIGN PATENT DOCUMENTS

| | | | |
|---|---|---|---|
| DE | 43 10 904 A1 | | 10/1994 |
| EP | 1 026 061 A3 | | 8/2000 |
| EP | 1 026 061 A2 | | 8/2000 |
| GB | 642098 | | 8/1950 |
| GB | 863030 | | 3/1961 |
| GB | 875087 | | 8/1961 |
| GB | 2 099 385 | * | 12/1982 |
| GB | 2 209 318 A | | 5/1989 |
| RU | 2016948 C1 | | 7/1994 |

* cited by examiner

*Primary Examiner*—Mark T. Le
(74) *Attorney, Agent, or Firm*—Laurence A. Greenberg; Werner H. Stemer; Ralph E. Locher

(57) ABSTRACT

Persons can be carried downhill from a mountain station to a valley station. A guide rail is fastened on a supporting cable at a distance above the ground. The guide rail is formed of a multiplicity of sub-rails and carriages with a chair, a cabin, or the like can be displaced along the rail. The sub-rails are connected to one another such that they can be displaced in the longitudinal direction of the guide rail.

11 Claims, 3 Drawing Sheets

INSTALLATION FOR CARRYING PERSONS FROM A HIGHER STATION TOWARDS A LOWER STATION

BACKGROUND OF THE INVENTION

Field of the Invention

The present invention relates to an installation for carrying individuals down from a higher station (a mountain station) towards a lower station (a valley station). The installation has a guide rail which is fastened on a supporting cable at a distance above the ground. The guide rail comprises a multiplicity of sub-rails. Carriages with a chair, a cabin, or the like can be displaced along the guide rail.

A system of that type is described in my earlier U.S. Pat. No. 6,360,669 and published European application EP 1 026 061 A2. There, the guide rail comprises a multiplicity of sub-rails which are connected rigidly to one another and are fastened on a supporting cable by means of brackets. Since, in the case of a rigid guide rail, those locations at which the carriages are located are subjected to very high loading in each case, the sub-rails and the connections thereof have to be of very large dimensions. In addition, such rails are also subjected to high levels of stressing, and resulting loading, on account of the heat expansion.

SUMMARY OF THE INVENTION

It is accordingly an object of the invention to provide an installation for the downhill transportation of persons from a higher station to a lower station, which overcomes the above-mentioned disadvantages of the heretofore-known devices and methods of this general type and which reduces the loading to which the guide rail is subjected, for which reason the guide rail may be of smaller dimensions.

With the foregoing and other objects in view there is provided, in accordance with the invention, an installation for downhill transportation of persons from a higher station to a lower station, comprising:

a guide rail extending between the higher station and the lower station and along which carriages are displaceable;

a supporting cable fastening the guide rail at a distance above ground;

the guide rail being formed of a multiplicity of sub-rails connected to one another and displaceable relative to one another in a longitudinal direction of the guide rail.

In other words, the objects of the invention are achieved in that the sub-rails are connected to one another such that they can be displaced in the longitudinal direction of the guide rail.

The sub-rails, i.e., the rail sections, are preferably designed as tubular elements which are designed in their interior, at their ends, with in each case at least one crosspiece passing through the interior, one of the crosspieces being provided with a slot and the crosspieces overlapping one another, it being the case that at least one screw which connects the crosspieces is provided between two sub-rails. According to a preferred embodiment, each sub-rail is designed, at one end, with a first crosspiece which is provided with a slot, and is designed, at its other end, with two further crosspieces, on which a screw is fastened, the two further crosspieces butting against the first crosspiece on both sides and the screw passing through the slot. Furthermore, the sub-rails are preferably fastened on the supporting cable by means of supporting brackets, it being possible for these to be displaced in relation to the supporting cable.

In accordance with an additional feature of the invention, the sub-rails are designed, on their outer sides, with at least one projecting bar along which guide rollers arranged on the carriage run, and projecting from the sub-rails is at least one further bar, which forms one of the two interacting elements of an electromagnetic braking arrangement. In this case, the at least one guide bar and the at least one braking bar may project more or less diametrically from the sub-rails.

Other features which are considered as characteristic for the invention are set forth in the appended claims.

Although the invention is illustrated and described herein as embodied in an installation for carrying individuals down from a mountain station into a valley station, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
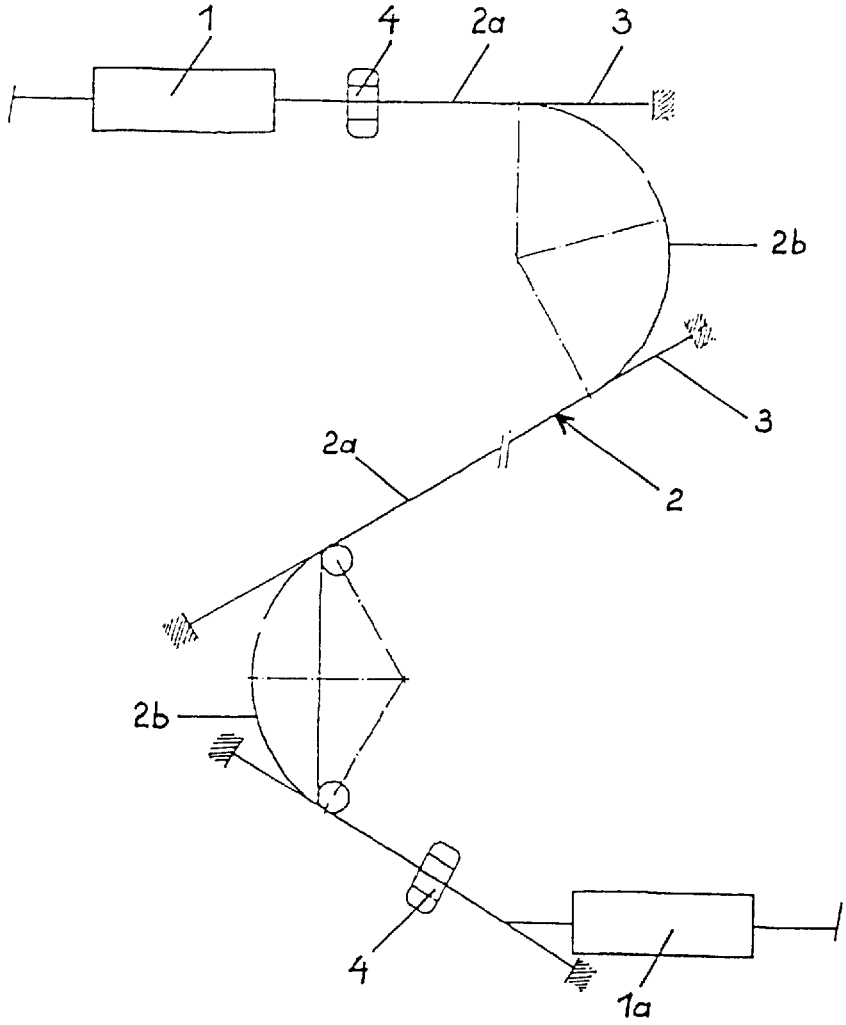
FIG. 1 is a schematic plan view of an installation according to the invention.

Referring now to the figures of the drawing in detail and first, particularly, to FIG. 1 thereof, there is shown an installation according to the invention with a higher station 1 (also referred to as a mountain station 1) and a lower station 1*a* (also referred to as a valley station 1*a*), between which a guide rail 2 extending from the mountain station 1 to the valley station 1*a* is located. The guide rail 2 has rectilinear segments 2*a* and curved segments 2*b*. Fastened on supports, columns and the like are supporting cables 3, on which the guide rail 2 is fastened at a distance above the ground. Carriages 4, on which chairs, suspension gear, cabins or the like are fastened, can be displaced along the guide rail 2 from the mountain station 1 towards the valley station 1*a*.

Figure 2:
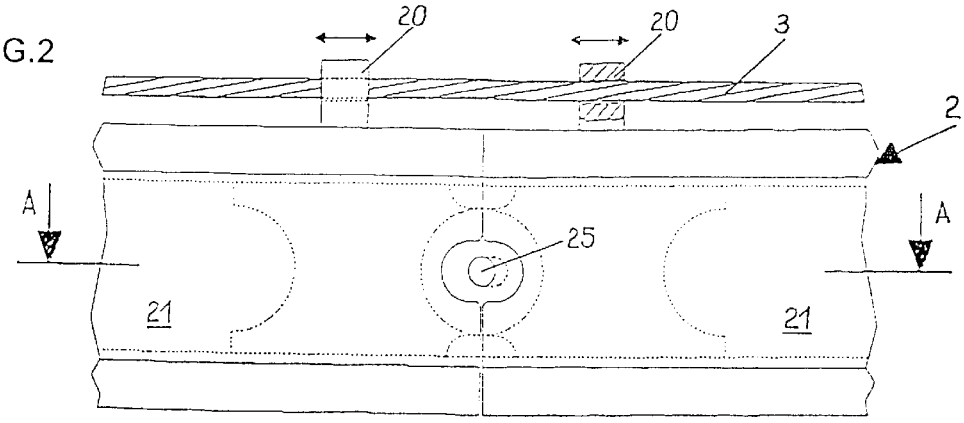
FIG. 2 is a partial side view illustrating the connection of two subrails in a first operating position.
Figure 2A:
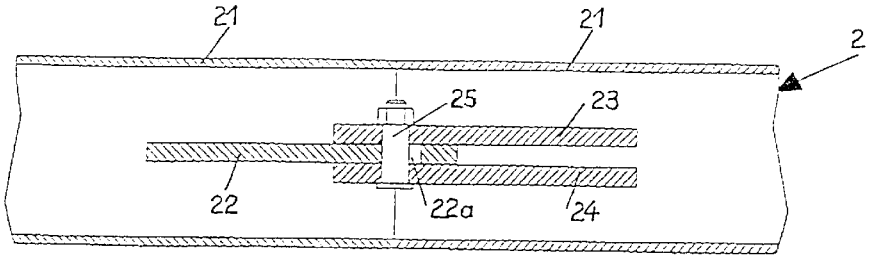
FIG. 2*a* is a section taken along the line A—A in FIG. 2, illustrating the connection of the sub-rails in the first operating position.

With reference to FIGS. 2 and 2*a*, the guide rail 2 comprises a multiplicity of sub-rails 21, which are fastened on the cable 3 by means of supporting brackets 20. The sub-rails 21, which, by way of for example, are of hollow-cylindrical design, are designed in the interior, at one end, with a more or less diagonally running crosspiece 22, which projects beyond the surface of the sub-rails 21 and which is formed with an elongated hole or slot 22*a*. At their other end, they are designed with two diagonally running crosspieces 23 and 24, which likewise project beyond the end surface of the sub-rails 21 and on which there is fastened at least one bolt 25, which passes through the slot 22*a*. The sub-rails 21 are connected to one another by means of the crosspieces 22, 23 and 24 and the bolts 25, it being possible for the sub-rails to be displaced in relation to one another by the length of the slot 22*a*. Since the supporting brackets 20 can be displaced in the longitudinal direction on the cable 3, this allows the sub-rails 21 to move in relation to one another in the longitudinal direction of the guide rail 2 in dependence on the loading to which they are subjected.

Figure 3:
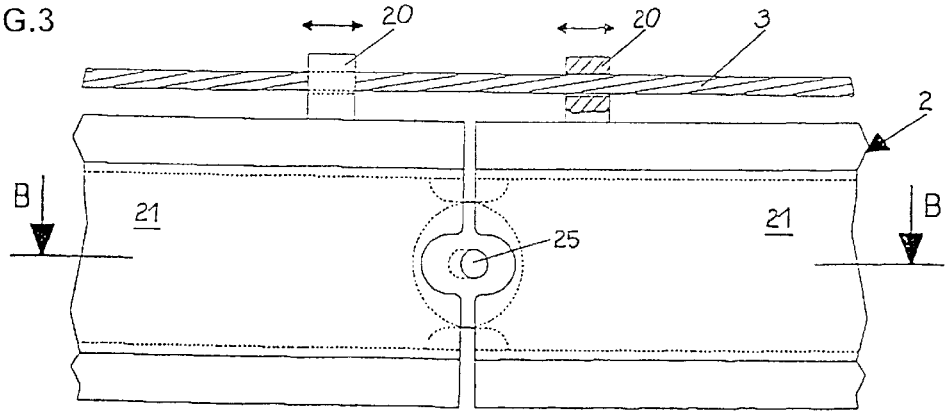
FIG. 3 is a partial side view illustrating the connection of the two sub-rails in a second operating position.
Figure 3A:
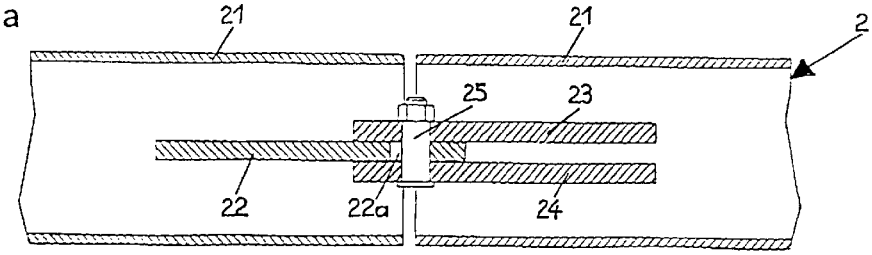
FIG. 3*a* is a section taken along the line B—B in FIG. 3, illustrating the connection of the sub-rails in the second operating position.

FIGS. 2 and 2*a* illustrate the position of the guide rail 2 in the non-loaded state. In this case, the ends of the sub-rails 21 butt against one another. In contrast, FIGS. 3 and 3*a* illustrate the sub-rails 21 in the position they assume when a carriage 4 is located in the region thereof. The resulting loading causes the guide rail 2 to bend, as a result of which the sub-rails 21 move apart from one another to the extent which is determined by the length of the slot 22*a*. Since the tensile forces acting on the guide rail 2 are thus reduced to a considerable extent, it is possible for the sub-rails 21 and the crosspieces 22, 23 and 24 connecting the same to be of far smaller dimensions than if the sub-rails 21 were connected rigidly to one another. In addition, the guide rail 2 can expand as a result of heat.

Figure 4:
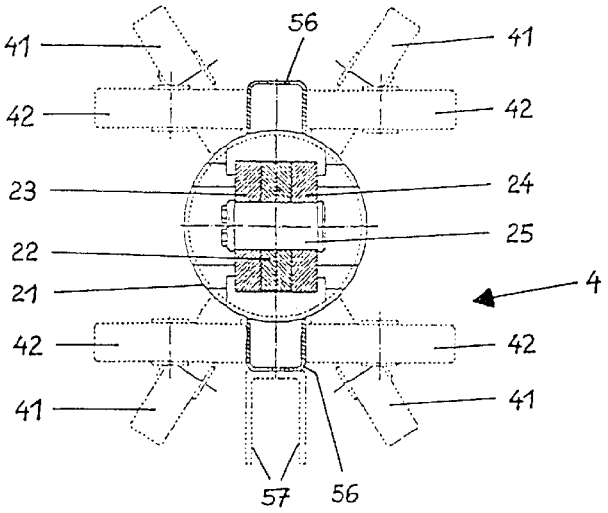
FIG. 4 is a cross-sectional view through two sub-rails in the region of their connection.

With reference to FIG. 4, supporting rollers 41 of the carriages 4 run on the surface of the sub-rails 21. Furthermore, the sub-rails 21 are designed, both on their top side and on their underside, with radially projecting continuations 56 which form abutment surfaces for guide rollers 42 of the carriages 4. Also projecting from the bottom continuation 56 are bars 57 which form constituent parts of an electromagnetic braking assembly. Additional information with regard to the electromagnetic braking assembly may be found in my copending patent application No. 10/062,057, published as US 2002/0108528 A1, the disclosure of which is herewith incorporated by reference.

Figure 5:
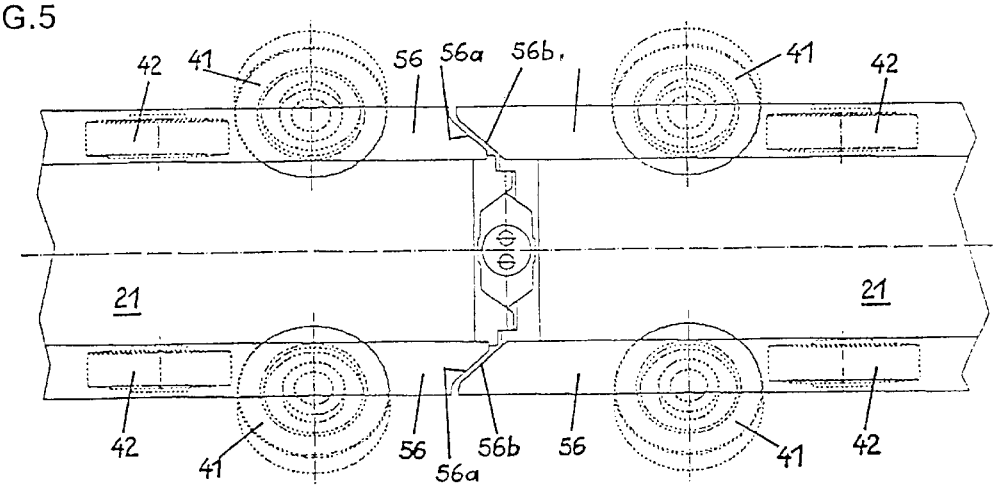
FIG. 5 is a side view of the end surfaces of two sub-rails.
Figure 5A:
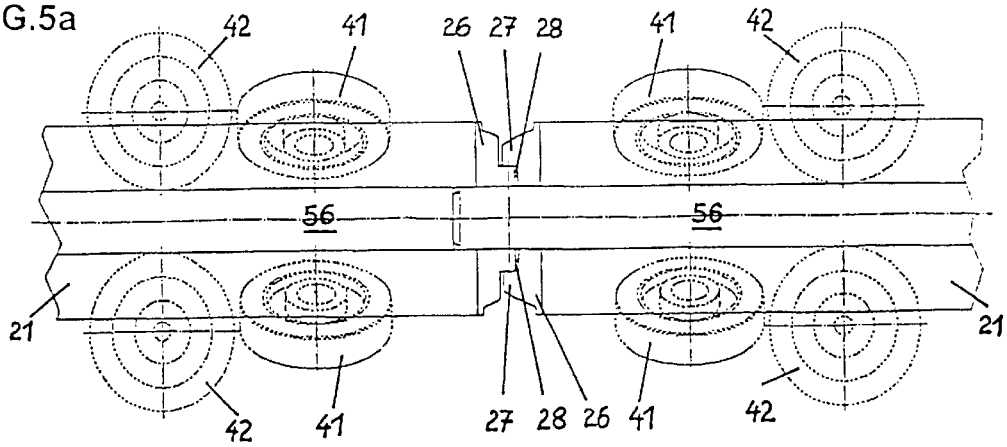
FIG. 5*a* is a plan view onto the end surfaces of the two subrails.

FIGS. 5 and 5*a*, furthermore, illustrate the configuration of the end surfaces of the sub-rails 21. As can be seen from FIG. 5, the continuations 56 are designed, in the longitudinal direction of the sub-rails 21, with mating bevels 56*a* and 56*b*. This ensures that the running surfaces for the guide rollers 42 are designed with a joint which runs obliquely in relation to the running direction, as a result of which the necessary smooth running of the guide rollers 42 is ensured. Analogously, the lateral surfaces of the sub-rails 21 are also designed, in the regions of the running surfaces for the supporting rollers 41, with mating protrusions 27, which are oriented in the running direction, and with mating recesses 28 assigned to said protrusions, as a result of which smooth rolling of the supporting rollers 41 is likewise ensured. The mutually assigned end surfaces of the sub-rails 21 are advantageously designed as annular, mating components 26 which are welded onto the end sides of the sub-rails 21.

I claim:

1. An installation for downhill transportation of persons from a higher station to a lower station, comprising:

a guide rail extending between the higher station and the lower station and along which carriages are displaceable;

a supporting cable fastening said guide rail at a distance above ground, and a plurality of supporting brackets mounting said guide rail to said supporting cable, said supporting brackets being displaceably attached to said supporting cable;

said guide rail being formed of a multiplicity of sub-rails connected to one another and displaceable relative to one another in a longitudinal direction of the guide rail.

2. The installation according to claim 1, wherein said sub-rails are tubular elements with ends and an interior, said ends are each formed with at least one crosspiece passing through said interior, one of said crosspieces is formed with an elongated hole and the crosspieces overlap one another, and wherein at least one screw connects said crosspieces between two respective said sub-rails.

3. The installation according to claim 2, wherein each said sub-rail has a first said crosspiece at one end thereof, formed with an elongated hole, and two further said crosspieces at another end thereof, said two further crosspieces butting against said first crosspiece on both sides when two sub-rails are connected to The another and said screw passing through said elongated hole.

4. The installation according to claim 1, wherein said supporting brackets fasten each of said sub-rails on said supporting cable.

5. The installation according to claim 1, wherein said sub-rails are formed, on an outer side thereof, with at least one projecting bar for running support of guide rollers arranged on the carriage.

6. The installation according to claim 5, which comprises at least one further bar projecting from said sub-rails, said further bar forming one of two interacting elements of an electromagnetic braking assembly.

7. The installation according to claim 6, wherein said at least one guide bar and said at least one braking bar project substantially diametrically from said sub-rails.

8. The installation according to claim 1, wherein said sub-rails are formed with running surfaces for supporting running rollers and for guide rollers of the carriages running along said guide rail in a running direction, and wherein said joints run in a step-like manner relative to the running direction.

9. The installation according to claim 1, wherein said sub-rails are formed with running surfaces for supporting running rollers and for guide rollers of the carriages running along said guide rail in a running direction, and wherein said joints are oriented obliquely relative to the running direction.

10. The installation according to claim 1, wherein said sub-rails have mutually assigned end surfaces formed with mating components welded onto respective ends of said sub-rails.

11. An installation for downhill transportation of persons from a higher station to a lower station, comprising:

a guide rail extending between the higher station and the lower station and along which carriages are displaceable;

a supporting cable fastening said guide rail at a distance above ground;

said guide rail being formed of a multiplicity of tubular sub-rails connected to one another and displaceable relative to one another in a longitudinal direction of the guide rail, said tubular sub-rails having ends and an interior, each of said ends being formed with at least one crosspiece passing through said interior, one of said crosspieces having an elongated hole formed therein and said crosspieces overlapping one another, and at least one screw bolt connecting said crosspieces between two respective said sub-rails.

* * * * *